US005321274A

United States Patent [19]

Yeh et al.

[11] Patent Number: 5,321,274

[45] Date of Patent: Jun. 14, 1994

[54] AUTOMATIC INTERMITTENT ENERGIZATION CONTROLLER OF ELECTROSTATIC PRECIPITATOR (ESP)

[75] Inventors: Chih-Chiang Yeh; Chuen-Ming Tsou; Jia-Shyan Ger; Rey-Chein Chang, all of Hsin-Chu, Taiwan

[73] Assignee: Industrial Technology Research Institute, Taiwan

[21] Appl. No.: 947,823

[22] Filed: Sep. 21, 1992

[51] Int. Cl.[5] ..... B03C 3/66; B03C 3/68

[52] U.S. Cl. ..... 250/573; 356/438; 96/19

[58] Field of Search ..... 250/564, 565, 573–575; 55/105, 106; 356/337, 338, 341, 433–438

[56] References Cited

U.S. PATENT DOCUMENTS 3,779,650 12/1973 Crowley ..... 356/438
3,919,702 11/1975 Hayes et al. ..... 356/434
4,017,193 4/1977 Loiterman ..... 356/438
4,284,417 8/1981 Reese et al. ..... 55/105
4,583,859 4/1986 Hall, II ..... 356/438
5,032,154 7/1991 Wright ..... 55/106
5,154,734 10/1992 Yung ..... 55/106
5,217,504 6/1993 Johansson ..... 55/105

*Primary Examiner*—David C. Nelms
*Assistant Examiner*—Stephone B. Allen
*Attorney, Agent, or Firm*—Michael D. Bednarek

[57] ABSTRACT

An electrostatic precipitator (ESP) intermittent energization controller is included with a CPU that adaptively controls the DC power used to energize the ESP. An opacimeter is mounted to the ESP for detecting the opacity of dust particles flowing through the same. The CPU searches through a table consisting of a predetermined number of charge-pause parameter sets until one charge-pause parameter set is found to cause the difference between the detected opacity level and the preset opacity level to be within a predetermined tolerable range.

4 Claims, 5 Drawing Sheets

(C,P)=(5,1)

(C,P)=(2,5)

AUTOMATIC INTERMITTENT ENERGIZATION CONTROLLER OF ELECTROSTATIC PRECIPITATOR (ESP)

BACKGROUND OF THE INVENTION

1. Field of the Invention

The present invention relates in general to an automatic intermittent energization controller for use in an electrostatic precipitator (ESP).

2. Description of Prior Art

For environmental protection purposes, factory facilities that produce exhaust gases are generally installed with electrostatic precipitators (ESP) to collect pollutant particles contained in the exhaust gas. A typical ESP includes collecting plates arranged in parallel to each other and discharge wires disposed between the collecting plates. A DC power is delivered to the discharge wires so that electrons discharged by the discharge wires, known as corona currents, cause ionizations of the pollutant particles passing through the ESP. The ionized dust particles are attracted by an electric fields established by the DC power to thereby be collected by the collecting plates.

For purposes of energy saving and higher dust-removing efficiency, the DC power delivering to the ESP can be varied in accordance with the concentration of pollutant particles passing through the ESP, i.e. the DC power is supplied with a maximum magnitude when there is detected a very large concentration of dust particles, and the DC power can be reduced when there is detected a low flow of dust particles.

A conventional power controller is shown in FIG. 1, in which an AC power source is used as the main power source generating an AC voltage $V_1(t)$ having a period of T, T=1/60 for typical industrial power applications, and with a waveform as illustrated in FIG. 2A. A thyristor circuit 20 is used in combination with a thyristor firing control circuit 30 to control the passing or cut-off of full sinusoidal cycles in the AC voltage $V_1(t)$. A charge period is herein and hereinafter defined as one period including a first predetermined number C of full sinusoidal cycles in the AC voltage $V_1(t)$ allowed to pass through the thyristor circuit 20; and a pause period, which appears right in subsequence to the end of one charge period, is herein and hereinafter defined as one period including a second predetermined number P of full sinusoidal cycles in the AC voltage $V_1(t)$ being cut off by the thyristor circuit 20. One charge period and its subsequent one pause period appear alternately with a period of $T_1+T_2$.

For an example as illustrated in FIG. 2B, if (C,P)=(5,1), then the thyristor circuit 20 allows five consecutive full sinusoidal cycles in $V_1(t)$ to pass therethrough and cuts off the subsequent one during a period of 6.T. For another example as illustrated in FIG. 2C, if (C,P)=(2,5), then the thyristor circuit 20 allows two consecutive full sinusoidal cycles in $V_1(t)$ to pass therethrough and cuts off the subsequent five during a period of 7.T.

The full sinusoidal cycles in $V_1(t)$ accordingly are sent intermittently via an low-to-high voltage transformer 40 to the AC-to-DC conversion circuit 50, which is used to generate a DC output $V_{DC}$ in proportion to the average power of $V_2(t)$. By fundamental electric principles, the output DC voltage is also in proportion to $R_c$, where:

$$R_c = \frac{C}{C+P}$$

A larger $R_c$ indicates more consumption of electrical energy, and a smaller $R_c$ indicates less consumption of electrical energy.

The selection of the charge-pause parameter set (C,P) for the conventional ESP energization controller is achieved only by manual input. Once the selection is made, the controller is not adaptive to changes in the flow rate of dust particles. The only way to change the DC power level input to the ESP is by means of input another new set of (C,P) manually. Therefore, the ESP operator has to be sitting by the ESP, monitoring the flow of dust particles and thereby choosing an appropriate set of (C,P) for adaptive control of the dust removing process.

SUMMARY OF THE INVENTION

It is therefore a primary object of the present invention to provide an ESP energization controller capable of controlling the level of DC power delivered to the ESP in accordance with flow rate of dust particles.

The ESP energization controller devised in accordance with the foregoing object is capable of determining an optimal level for the DC power by which the dust particles flowing through the electrostatic precipitator is with a detected opacity level substantially equal to a preset opacity level. This is achieved by the provision of a CPU and an opacimeter. The opacimeter is mounted to the ESP for detecting the opacity of dust particles flowing through the same. The CPU compares the detected opacity level with the preset opacity level and accordingly searches in a table having a number of predetermined charge-pause parameter sets to find one charge-pause parameter set capable of causing the detected opacity level to be within a predetermined range.

BRIEF DESCRIPTION OF THE DRAWINGS

The present invention can be more fully understood by reading the subsequent detailed description of the preferred embodiments thereof with references made to the accompanying drawings, wherein:

FIGS. 2A–2C are signal diagrams, in which

FIG. 2A shows that of an AC voltage,

FIG. 2B shows that of a partially chopped AC voltage corresponding to a charge-pause set (C,P)=(5,1), and FIG. 2C shows that of another partially chopped AC voltage corresponding to a charge-pause set (C,P)=(2,5);

DETAILED DESCRIPTION OF THE PREFERRED EMBODIMENTS

Figure 1:
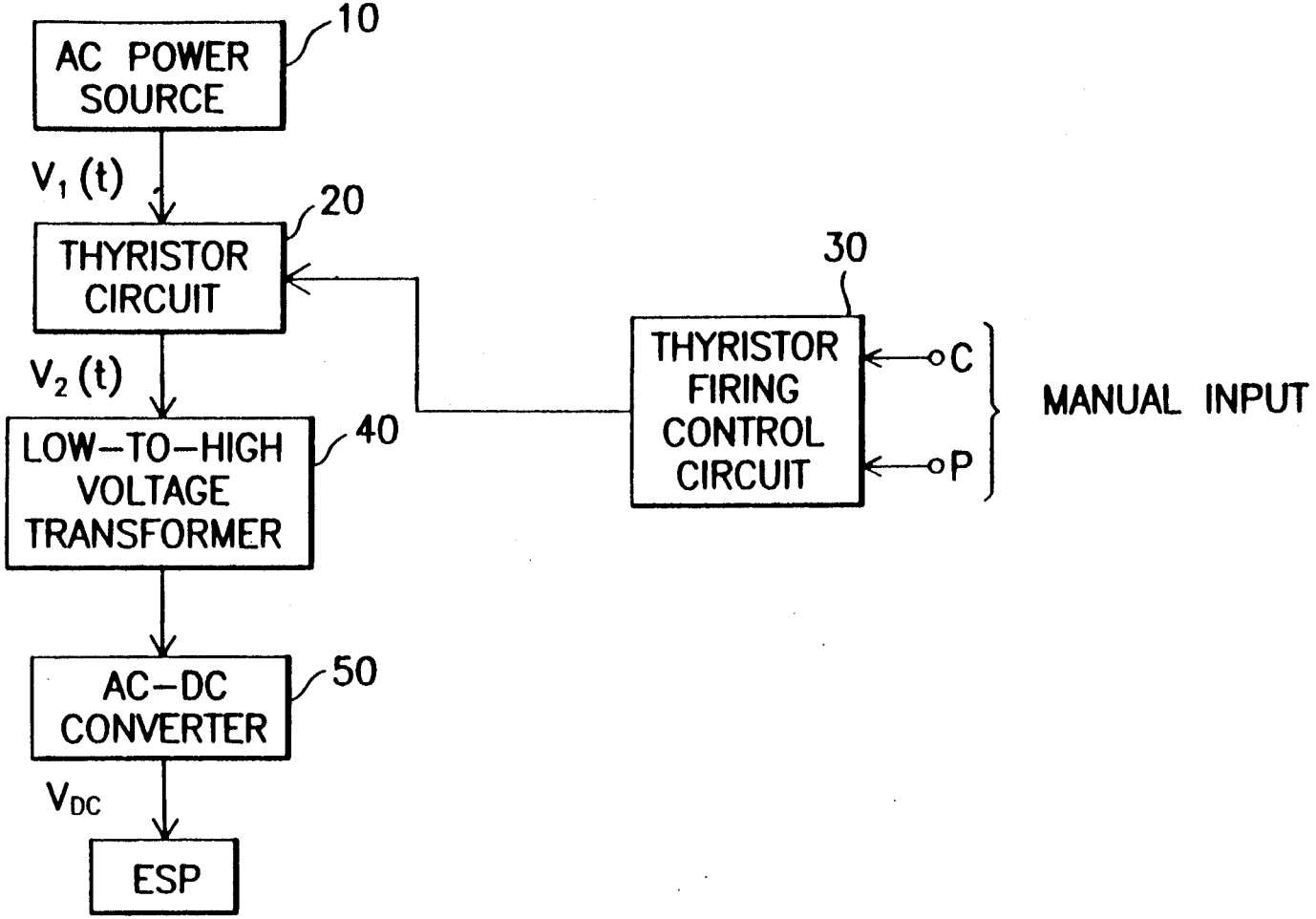
FIG. 1(PRIOR ART)
FIG. 1 is a block diagram of a conventional ESP intermittent energization controller.
Figure 2A:
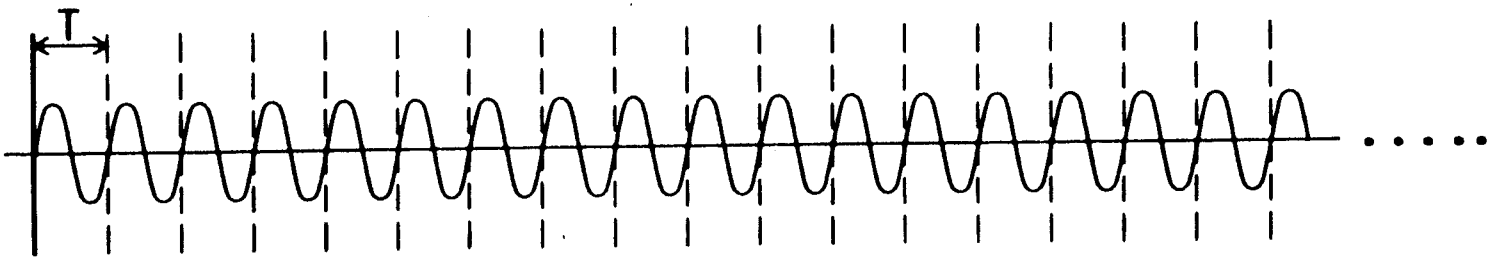
Figure 2B:
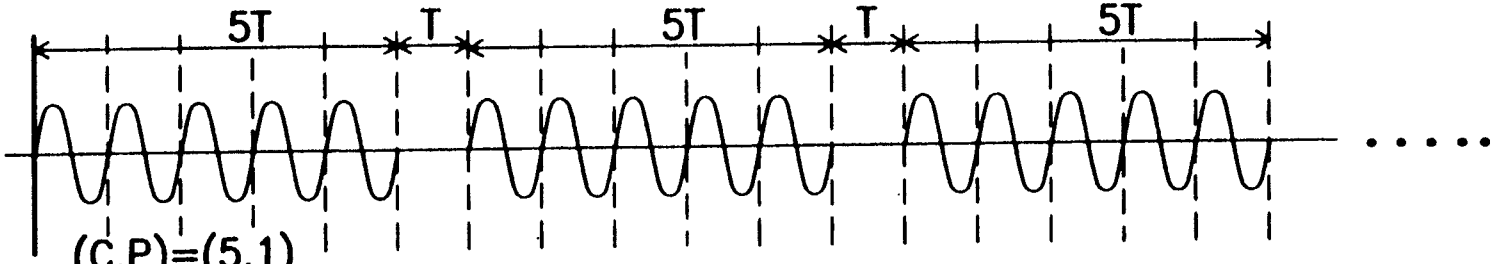
Figure 2C:
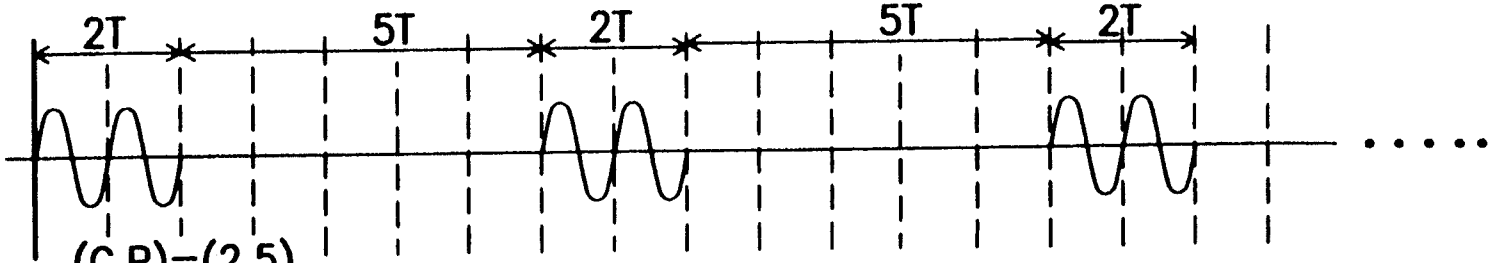
Figure 3:
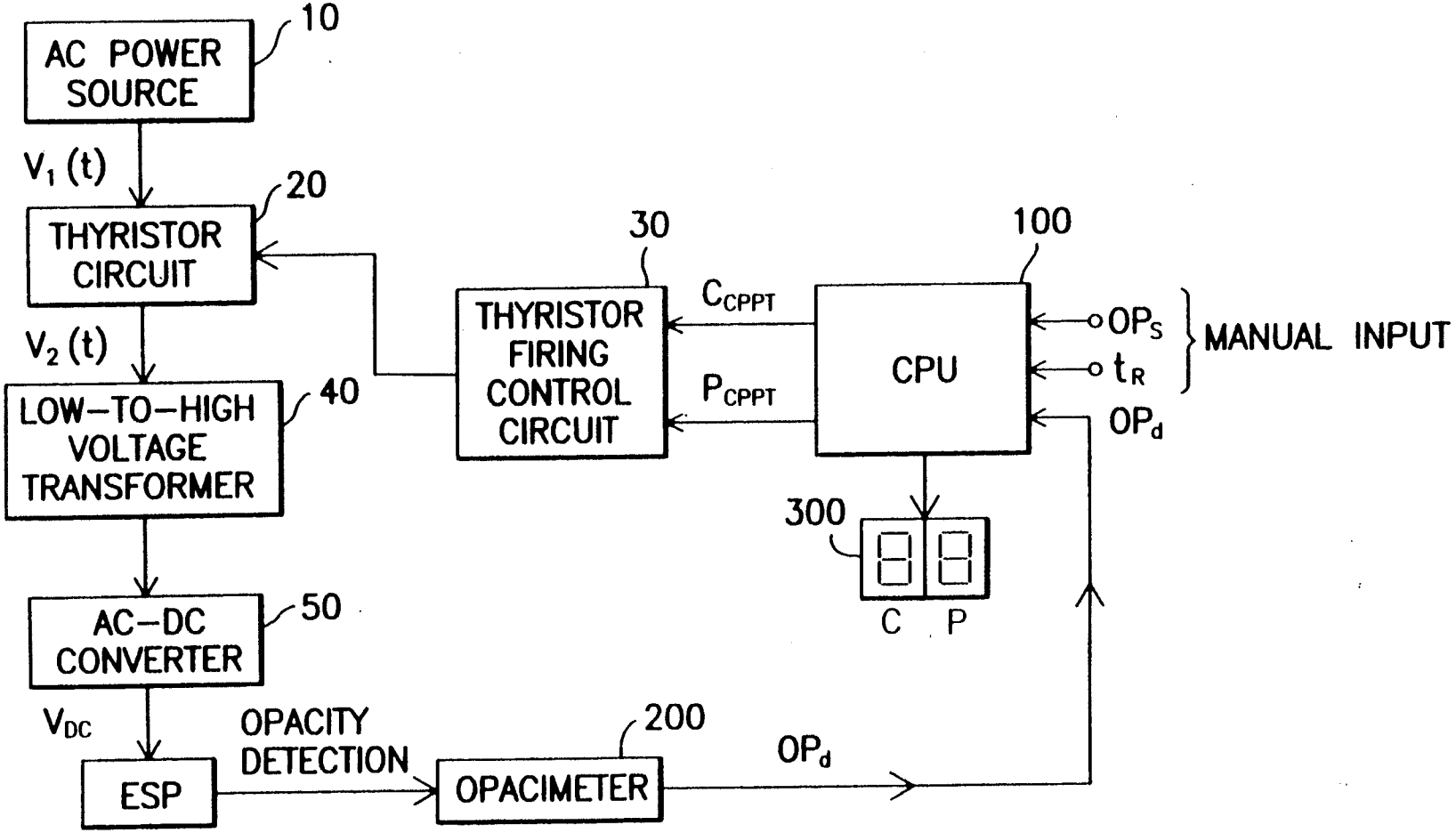
FIG. 3 is a block diagram of an ESP energization controller devised according to the present invention.

Referring to FIG. 3, it is shown the block diagram of an automatic ESP intermittent energization controller devised in accordance with the present invention. In the drawing, blocks that are unchanged in view of the old blocks of the conventional ESP intermittent energization controller of FIG. 1 are labelled with the same reference numerals. The ESP intermittent energization controller of FIG. 3 includes additionally a CPU 100 and an opacimeter 200 mounted to the collecting plate of the ESP.

The opacimeter 200, which is an optical device including a light beam emitter and a photo-detector (both are not shown), is used to detect the opacity of dust particles flowing through the ESP. The light beam emitter is used to emit a light beam, which passes through the passageway of the dust particles to the photo-detector, thereby actuating the photo-detector to generate an electrical signal $OP_d$ representing the detected opacity of the dust flow in the ESP. The electrical signal $OP_d$ is fed back to the CPU 100. If there is a large concentration of dust particles, the photo-detector detects a faint light beam and thereby generates a smaller electrical current; and if there is a small concentration of dust particles, the photo-detector detects a brighter light beam and thereby generates a larger electrical current. The magnitude of the electrical current generated by the photo-detector can accordingly be used to indicate the opaqueness of the dust flows. The unit used to represent the opaqueness is termed opacity, a larger opacity value indicating a large flow of dust particles and a smaller opacity value indicating a small flow of dust particles.

Prior to the operation of the automatic ESP intermittent energization controller, two predetermined constant parameters, $OP_s$ and $t_R$ are given by manual operations to the CPU 100, where $OP_s$ is a preset desired opaqueness for the dust flows, and $t_R$ is the residence time of dust flows in the ESP. The function of the CPU 100 is to determine the optimal values for the charge-pause set in response to the detected opaqueness $OP_d$ of the dust flows. The optimal charge-pause set, once determined, is sent to the thyristor control circuit 40.

Figure 4A:
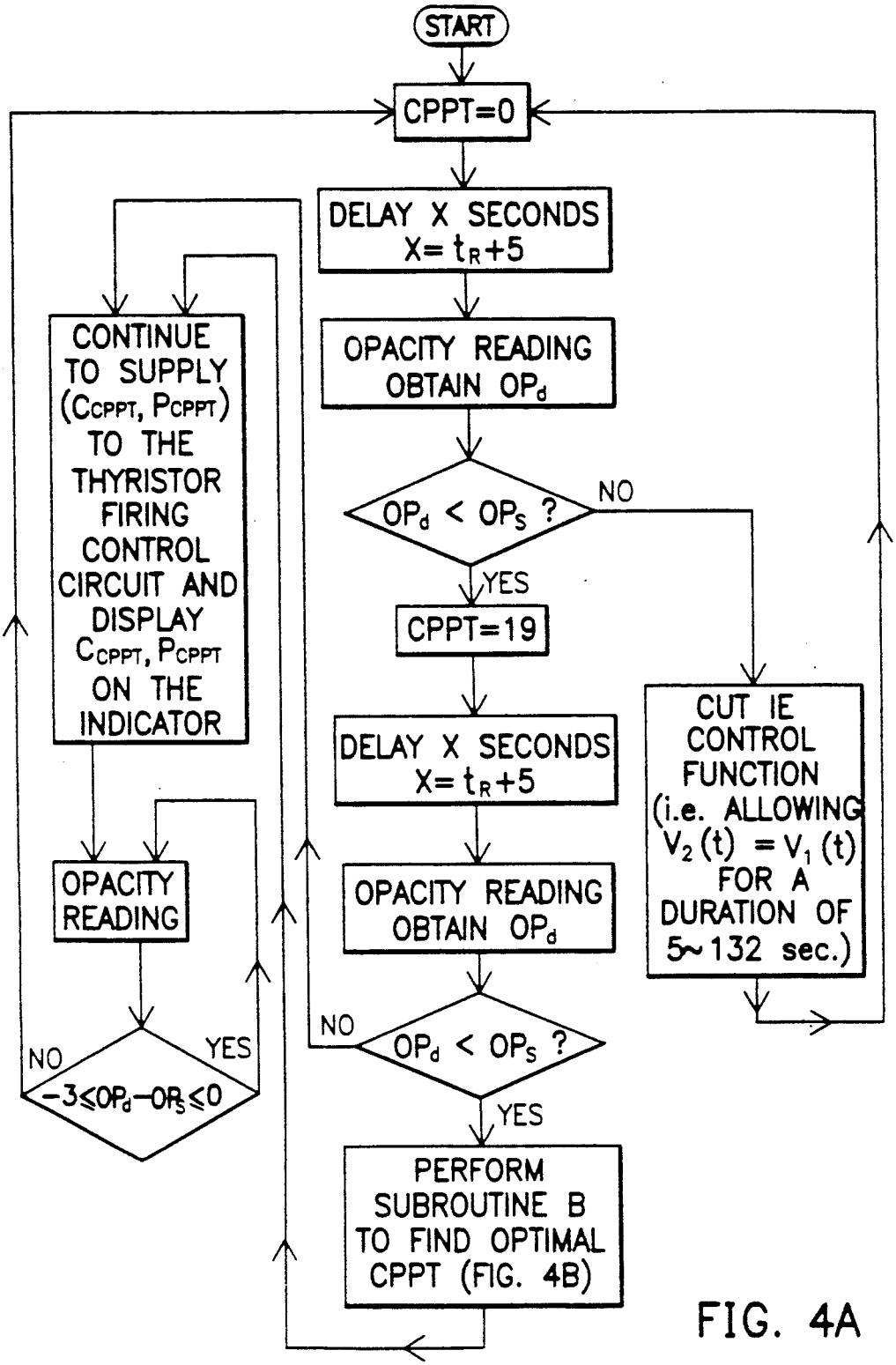
FIGS. 4A–4B shows the flow diagrams of procedural steps performed by a CPU used in the ESP energization controller of FIG. 3.

The flow diagram of the program executed by the CPU 100 is shown in FIG. 4. To find the optimal charge-pause set, a table search method is used to search among twenty predetermined charge-pause sets, which include:

$(C_0,P_0)=(5,1)$,
$(C_1,P_1)=(4,1)$,
$(C_2,P_2)=(3,1)$,
$(C_3,P_3)=(5,2)$,
$(C_4,P_4)=(2,1)$,
$(C_5,P_5)=(4,2)$,
$(C_6,P_6)=(5,3)$,
$(C_7,P_7)=(3,2)$,
$(C_8,P_8)=(4,3)$,
$(C_9,P_9)=(5,4)$,
$(C_{10},P_{10})=(2,2)$,
$(C_{11},P_{11})=(3,3)$,
$(C_{12},P_{12})=(4,4)$,
$(C_{13},P_{13})=(5,5)$,
$(C_{14},P_{14})=(2,3)$,
$(C_{15},P_{15})=(3,4)$,
$(C_{16},P_{16})=(4,5)$,
$(C_{17},P_{17})=(3,5)$,
$(C_{18},P_{18})=(2,4)$, and
$(C_{19},P_{19})=(2,5)$.

If $i<j$, then the charge-pause set $(C_i,P_i)$ actuates larger DC power to the ESP than the charge-pause set $(C_j,P_j)$. The output charge-pause set of the CPU 100 can be expressed by $(C_{CPPT},P_{CPPT})$, where $0 \leqq CPPT \leqq 19$.

At the start of the program, the CPU 100 selects CPPT=0, i.e. $(C_{CPPT},P_{CPPT})=(C_0,P_0)=(5,1)$, as its output to the thyristor control circuit 30. With the DC power actuated by this pause-charge rate, the CPU 100 subsequently performs the step of opacity reading, during which the CPU 100 reads the output of the opacimeter 200 consecutively at an interval of two seconds for ten times to thereby collect ten detected opacity readouts. The ten readout data are then averaged to obtain $OP_d$.

The value $OP_d$ is compared with the preset value $OP_s$. If the value $OP_d>OP_s$, it is indicated that a high concentration of dust particles is still present in the ESP and thus the DC power actuated by the charge-pause parameter set corresponding to CPPT=0 is not high enough to remove the dust particles efficiently. Therefore, all the cycles of the AC output $V_1(t)$ are transmitted without being partially chopped to the AC-to-DC converter 40 to actuate a maximum delivering of the DC power to the ESP. The full transmission of the AC power will last for about 5 to 132 seconds. After that, the CPU 100 returns the first step of the program.

On the other hand, if the value $OP_d<OP_s$, it is indicated that a low flow rate of dust particles is present in the ESP and thus a more-than-needed DC power is actuated by the charge-pause rate corresponding to CPPT=0. As a consequence, the CPU 100 tries CPPT=19, i.e. using $(C_{CPPT},P_{CPPT})=(C_{19},P_{19})=(2,5)$, to actuate the lowest DC power. With this pause-charge parameter set, the CPU 100 again reads the output of the opacimeter 200 consecutively at an interval of two second for ten times to thereby collect ten opacity readouts. The ten readout data are then averaged to obtain a new $OP_d$.

The new $OP_d$ is also compared with the preset value $OP_s$. If $OP_d<OP_s$, it is indicated that a very low flow rate of dust particles is present in the ESP. In this case, the charge-pause ratio corresponding to CPPT=19 is maintained as the output of the CPU 100 to the thyristor firing control circuit 30. At the same time, the CPU 100 displays (5,2) on the indicator 300 to inform the ESP operator.

On the other hand, if the value $OP_d>OP_s$, it is indicated that the optimal charge-pause parameter set $(C_{CPPT},P_{CPPT})$ should be with its index CPPT somewhere between 0 and 19. The flow diagram for finding the optimal charge-pause parameter set is shown in FIG. 4B.

Figure 4B:
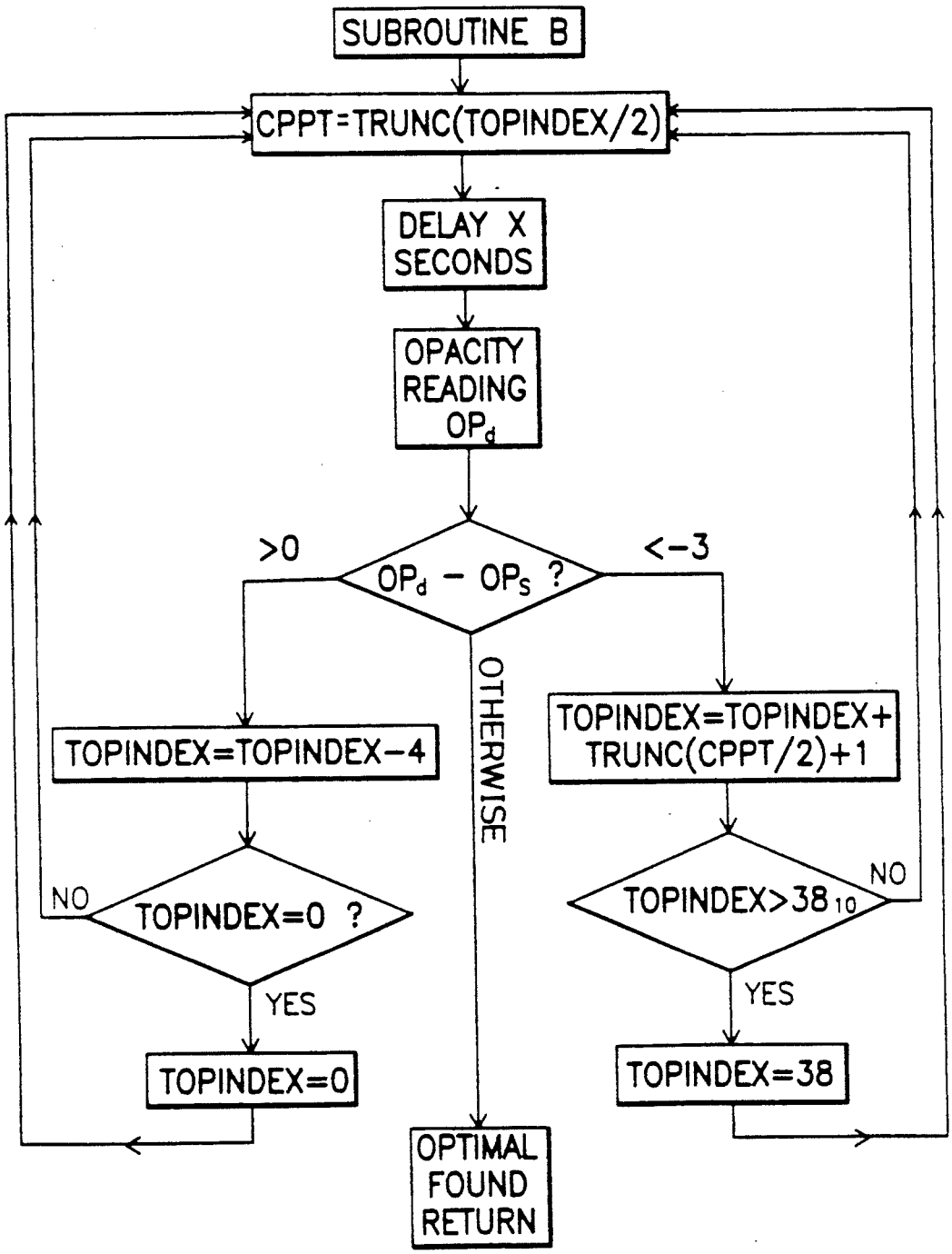

Referring to FIG. 4B, the CPU 100 then tries a new charge-pause parameter set $(C_{CPPT},P_{CPPT})$ with the CPPT determined by the following operation:

$$CPPT=TRUNC(TOPINDEX/2),$$

where TRUNC( ) is an arithmetic function that generates an integer number by truncating the mantissa portion of the number within the parenthesis, and TOPINDEX is an integer number preset at 19, which is the bottom value for CPPT, Accordingly, CPPT=9 is selected and the step of opacity reading is performed again to obtain a new $OP_d$ to be compared also with $OP_s$. In this preferred embodiment of the present invention, if $OP_d-OP_s$ is in the range from $-3$ to 0, then the current value of CPPT is accepted as the optimal index for $(C_{CPPT},P_{CPPT})$ to be sent out by the CPU 100 to the thyristor firing control circuit 30.

Accordingly, if $OP_d-OP_s \leqq -3$, it is implied that the optimal charge-pause parameter set $(C_{CPPT},P_{CPPT})$ should be with its index CPPT lying somewhere between 0 and 9. In this case, the CPU 100 performs the arithmetic operation:

$$TOPINDEX = TOPINDEX - 4,$$

so that TOPINDEX is changed from 19 to 15, and whereby CPPT=7 is obtained at the subsequent step. The CPU 100 performs these steps repeatedly until one index value CPPT causing $-3 \leqq OP_d - OP_s \leqq 0$ is found. Once the optimal index CPPT is found, the CPU 100 continues to send ($C_{CPPT}$,$P_{CPPT}$) to the thyristor firing control circuit 30 and to display the values of $C_{CPPT}$ and $P_{CPPT}$ on the indicator 200.

On the other hand, if $OP_d - OP_s \geqq 0$, it is implied that the optimal charge-pause parameter set should be with the index CPPT lying somewhere between 11 and 18. In this case, the CPU 100 performs the arithmetic operation:

$$TOPINDEX = TOPINDEX + TRUNC(CPPT/2) + 1,$$

so that TOPINDEX is changed from 19 to 24, and whereby CPPT=12 is obtained at the subsequent step. The CPU 100 performs these procedural steps repeatedly until one index value CPPT causing $-3 \leqq OP_d - OP_s \leqq 0$ is found. Once the optimal CPPT is found, the CPU 100 continues to send ($C_{CPPT}$,$P_{CPPT}$) corresponding to the optimal CPPT to the thyristor firing control circuit 30 and to display the values of $C_{CPPT}$ and $P_{CPPT}$ on the indicator 300.

After the optimal index value CPPT is found for the charge-pause parameter set, the CPU 100 continues to monitor the opacity of the dust flow. Once a detected opacity value $OP_d$ is outside the tolerable range of $-3 \leqq OP_d - OP_s \leqq 0$, the CPU 100 will perform the program from the first step to find another optimal charge-pause parameter set.

The present invention has been described hitherto with an exemplary preferred embodiment. However, it is to be understood that the scope of the present invention need not be limited to the disclosed preferred embodiment. On the contrary, it is intended to cover various modifications and similar arrangements within the scope defined in the following appended claims. The scope of the claims should be accorded the broadest interpretation so as to encompass all such modifications and similar arrangements.

What is claimed is:

1. In combination with an electrostatic precipitator having the energization thereof actuated by DC power supplied by an AC-to-DC converting means coupled to a source of AC power, an apparatus for controlling the magnitude of the DC power by adjusting a charge-pulse ratio for the AC power, said apparatus comprising:

(a) an opacimeter for detecting the opacity of dust particles flowing through the electrostatic precipitator;

(b) CPU means for determining an optimal level of the DC power at which the dust particles flowing through said electrostatic precipitator have a detected opacity level $OP_d$ within a predetermined tolerable range relative to a preset opacity level $OP_s$, said CPU means comparing said detected opacity level $OP_d$ with said preset opacity level $OP_s$ and searching through a table consisting of a predetermined number of charge-pause ratios, each of said charge-paused ratios actuating one corresponding DC power level, until one of said charge-pause ratios is found to cause the difference between said detected opacity level $OP_d$ and said present opacity level $OP_s$ to be within the predetermined tolerable range.

2. An apparatus as recited in claim 1, wherein the charge-pause ratio table includes 20 entries.

3. An apparatus as recited in claim 1, wherein the predetermined tolerable range for the detected opacity level $OP_d$ is $-3 \leqq OP_d - OP_s \leqq 0$.

4. An apparatus as claimed in claim 1, wherein said CPU means continuously monitors the opacity of dust particles flowing through said electrostatic precipitator after an optimal level of the DC power is found, and if the difference between said detected opacity level and said preset opacity level is detected to drift out of said predetermined tolerable range, said CPU means repeatedly performs the search through said charge-pause ratio table again.

* * * * *